US012789065B2

(12) United States Patent
Sullivan

(10) Patent No.: US 12,789,065 B2
(45) Date of Patent: Nov. 10, 2026

(54) HOCKEY STICK GRIP ASSEMBLY

(71) Applicant: Ryan Patrick Sullivan, North Truro, MA (US)

(72) Inventor: Ryan Patrick Sullivan, North Truro, MA (US)

( * ) Notice: Subject to any disclaimer, the term of this patent is extended or adjusted under 35 U.S.C. 154(b) by 368 days.

(21) Appl. No.: 18/401,291

(22) Filed: Dec. 29, 2023

(65) Prior Publication Data

US 2025/0213949 A1 Jul. 3, 2025

(51) Int. Cl.

| | |
|---|---|
| ***A63B 69/00*** | (2006.01) |
| ***A63B 60/08*** | (2015.01) |
| ***A63B 60/14*** | (2015.01) |

(52) U.S. Cl.

CPC ..... *A63B 69/0026* (2013.01); *A63B 60/08* (2015.10); *A63B 60/14* (2015.10); *A63B 2209/10* (2013.01)

(58) Field of Classification Search

CPC ..... A63B 69/0026; A63B 60/08; A63B 60/14
USPC ..... 473/448
See application file for complete search history.

(56) References Cited

U.S. PATENT DOCUMENTS

| | | | | |
|---|---|---|---|---|
| 3,834,697 | A * | 9/1974 | McNamara, Jr. .. | A63B 69/0026 473/437 |
| 6,939,273 | B2 * | 9/2005 | Zajac ..... | A63B 21/06 473/437 |
| 8,500,609 | B1 * | 8/2013 | Williams ..... | A63B 21/0726 482/109 |
| 12,330,033 | B2 * | 6/2025 | Cather ..... | A63B 60/24 473/437 |
| 2013/0172136 | A1 * | 7/2013 | Heiberg ..... | A63B 59/50 473/564 |
| 2021/0154546 | A1 * | 5/2021 | Sliepka ..... | A63B 60/08 473/437 |
| 2022/0111273 | A1 * | 4/2022 | Aiello ..... | A63B 60/14 473/448 |
| 2025/0213949 | A1 * | 7/2025 | Sullivan ..... | A63B 60/12 473/448 |
| 2025/0249327 | A1 * | 8/2025 | Terlik ..... | A63B 69/0026 473/448 |

* cited by examiner

*Primary Examiner* — Mitra Aryanpour
(74) *Attorney, Agent, or Firm* — The Rapacke Law Group, P.A.; Andrew S. Rapacke; Kenneth F. Brooks

(57) ABSTRACT

A slidable and rotatable training and ergonomic handle for an ice hockey stick includes two hinged halves forming a tube sized to exceed the thickness of the elongated shaft of the hockey stick. The reduced grip upon the elongated shaft generally encourages the user to focus on manipulating another hand closer to the butt end of the ice hockey stick.

15 Claims, 3 Drawing Sheets

HOCKEY STICK GRIP ASSEMBLY

CROSS-REFERENCE TO RELATED APPLICATION

This application claims the benefit of U.S. Provisional Application No. 63/584,848 filed on Sep. 22, 2023 and U.S. Provisional Application No. 63/589,996 filed on Oct. 13, 2023, the disclosures therein are incorporated herein in their entirety.

TECHNICAL FIELD

The embodiments generally relate to the field of sports equipment. More particularly, some embodiments relate to training and/or ergonomic handles for ice hockey sticks.

BACKGROUND

Proper hand placement/movement upon a hockey stick is generally important to hockey players especially during critical games moments such as attempts to score, passing or maneuvering to score, or retaining/gaining possession of the hockey puck. Proper hand placement/movement is often impeded by relative heavy protective gloves generally intended to protect the hands from impacts or abrasions during game play or practice. While the glove portions covering the dorsal and lateral sides of the hands tend to include thicker, more durable material; the palm-side portions tend to be made of thinner, less durable material (e.g., layer of leather sometimes even intentionally softened) for improved tactile sensation particularly regarding the position/movement of the hockey stick. Usually, these gloves are too bulky overall, often with there being almost no space between fingers particularly on the dorsal sides of the hand—to permit individualized recesses on the hockey stick (or an attachment to a hockey stick) for placement of the fingers (or finger portions of the glove) for each finger.

Preferable hand placement/movement can also be impeded by the fact that many hockey players will lock their lower hand upon a particular spot along the shaft of the hockey stick throughout a movement of the hockey stick involving at least a partially rotational movement when hand movement along the shaft of the hockey stick might be preferable (ergonomically and performance-wise) throughout the at least partially rotational movement. Such strong welding of the lower hand to a particular spot on the hockey stick might be typified when a player places his hand during a particularly strong shot attempt and likely represents an attempt to generate increased force and resultant increased speed with the shot attempt with less time for opposing players to react to and defend against the shot attempt. Some players attempt to improve this welding of hand to a particular spot on the hockey stick shaft by applying friction increasing material to a particular spot on their hockey stick shaft. Some materials used include textured cloth tape (sometimes leaching adhesive) or tape with adhesive on both sides wrapped around the particular spot on the hockey stick shaft; or sticky liquids and/or aerosol sprays. However, such tape, liquids, and sprays generally lessen in effectiveness rather quickly requiring reapplication (and/or removal of old tape)—and their associated components can have a deleterious effect upon the palm-side portions of the glove potentially resulting in expensive replacement (or re-palming) of the gloves.

Repositioning of the hands along the bare, taped, liquid-applied, or sprayed shaft of the hockey stick can be problematic. It requires effort to remove one's hands from a tacky substance with resultant, potentially unintentional continuing inertial movement. Additionally, the hands may be re-placed upon a less frictional section of the shaft resulting in unintended slippage of the hands, with the player exerting more effort to grip the shaft to avoid unintended slippage.

There is a need for an enhanced interface or intermediary between ice hockey gloves, especially the palm-side portions of the glove, and the portion(s) of the ice hockey stick shaft generally held by the lower hand of a hockey player during game play or practice. This is specially one allowing movement of the hand along the shaft during an at least partially rotational movement preferably with features improving the player's tactile sensing of the placement/movement of the hockey stick.

SUMMARY OF THE INVENTION

This summary is provided to introduce a variety of concepts in a simplified form that is further disclosed in the detailed description of the embodiments. This summary is not intended for determining the scope of the claimed subject matter.

A slidable and rotatable training and ergonomic handle for an ice hockey stick includes two hinged halves forming a tube sized to exceed the thickness of the elongated shaft of the hockey stick. The reduced grip upon the elongated shaft generally encourages the user to focus on manipulating another hand closer to the butt end of the ice hockey stick.

The assembly is a hockey training device to help players develop their shooting and stickhandling abilities. The assembly attaches to the user's bottom hand, or bottom gloved hand. The assembly may be secured using neoprene straps so that when the device is engaged, or closed, and prevents the player from firmly gripping the stick with their bottom hand. The device is designed so that the shaft of the players stick can slide and rotate freely within the device while it is engaged or closed.

In one aspect, the first handle assembly body and second handle assembly body each define an essentially semi-cylindrical shell configurable to hingeably form an essentially elongated tubular body.

In one aspect, a connecting hinge pin joins the first and second handle assembly bodies via at least one hinge knuckle integral with each separate handle assembly body.

In one aspect, the assembly is further configurable to be slidable along a section of the elongated shaft of an ice hockey stick.

In one aspect, the assembly is further configurable to be rotatable around the elongated shaft of an ice hockey stick.

In one aspect, the assembly is further configured to be rotatable around the elongated shaft of an ice hockey stick.

In one aspect, the assembly includes at least one hinge knuckle on the first handle assembly body defining a detent engageable with a notch defined on the second handle assembly body.

In one aspect, the first and second handle assembly bodies each define at least two spaced slots, the first and second handle assembly bodies configured to respectively receive and retain a first and a second strap on the inside surface of the generally tubular body wherein each of the first and second straps is integral with loopable material configured generally on the outside of the generally tubular body.

In one aspect, the first and second handle assembly bodies each further define recesses between at least two defined slots, said recesses not traversing the entire thickness of the elongated hollow body and being further configured to receive and recess a strap.

In one aspect, the assembly includes a first raised spacer orientated longitudinally along the inner surface of the first handle assembly body adjacent to at least one defined recess of the first handle assembly configurable to space the elongated shaft of the hockey stick and a first strap. Further the assembly includes a second raised spacer orientated longitudinally along the inner surface of the second handle assembly body adjacent to at least one defined recess of the second handle assembly configurable to space the elongated shaft of the hockey stick and a second strap.

In one aspect, the loopable material comprises a hook and loop material configurable to attach to itself while wrap around some portion of a user's hand.

In one aspect, the first handle assembly body defines two spaced slots in staggered formation with three spaced slots defined by the second handle assembly body.

In one aspect two spaced slots defined by the first handle assembly anchor a first loop configured to retain some portion of an upper limb (usually the hand) of a user while two spaced slots defined by the second handle assembly anchor a second loop configured to retain a thumb of a user.

In one aspect, the assembly is configured to limit a user's ability to firmly grip the elongated shaft of the ice hockey stick thereby encouraging the user to rely more on manipulating another hand closer to a butt end of the ice hockey stick.

In one aspect, the assembly may be comprised of a rigid material such as plastic.

In one aspect, the general outer surface is defined by the first and second handle assembly body and includes a slip resistant texture.

In one aspect, the general outer surface comprises a slip resistant material or texture.

BRIEF DESCRIPTION OF THE DRAWINGS

A complete understanding of the present embodiments and the advantages and features thereof will be more readily understood by reference to the following detailed description when considered in conjunction with the accompanying drawings wherein.

DETAILED DESCRIPTION

Figure 1:
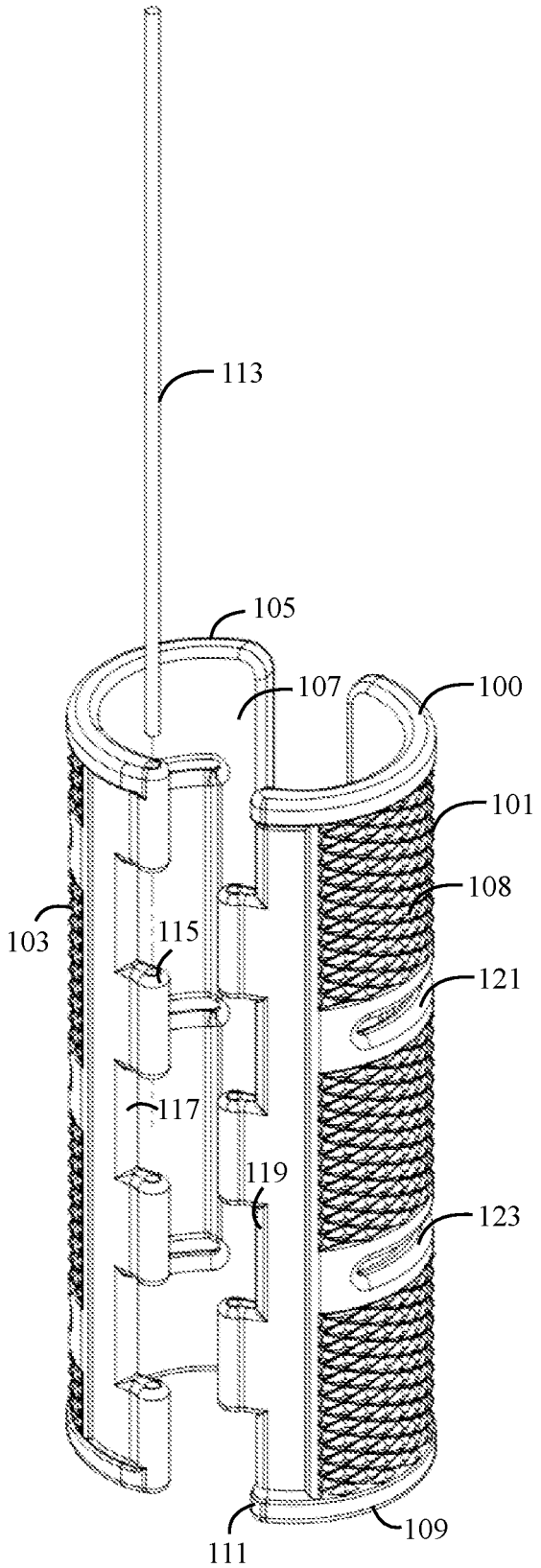
FIG. 1 illustrates a perspective view of the hockey stick grip assembly, according to some embodiments.

The specific details of the single embodiment or variety of embodiments described herein are set forth in this application. Any specific details of the embodiments described herein are used for demonstration purposes only, and no unnecessary limitation(s) or inference(s) are to be understood or imputed therefrom.

Before describing in detail exemplary embodiments, it is noted that the embodiments reside primarily in combinations of components related to particular devices and systems. Accordingly, the device components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

In general, the embodiments provided herein relate to a slidable and rotatable training and ergonomic handle for an ice hockey stick includes two hinged halves forming a tube sized to exceed the thickness of the elongated shaft of the hockey stick. The reduced grip upon the elongated shaft generally encourages the user to focus on manipulating another hand closer to the butt end of the ice hockey stick. The assembly is a hockey training device to help players develop their shooting and stickhandling abilities. The assembly attaches to the user's bottom hand, or bottom gloved hand. The assembly may be secured using neoprene straps having a hook and loop system so that when the device is engaged, or closed, and prevents the player from firmly gripping the stick with that hand. The device is designed so that the shaft of the players stick can slide and rotate freely within the device while it is engaged or closed.

Figure 2:
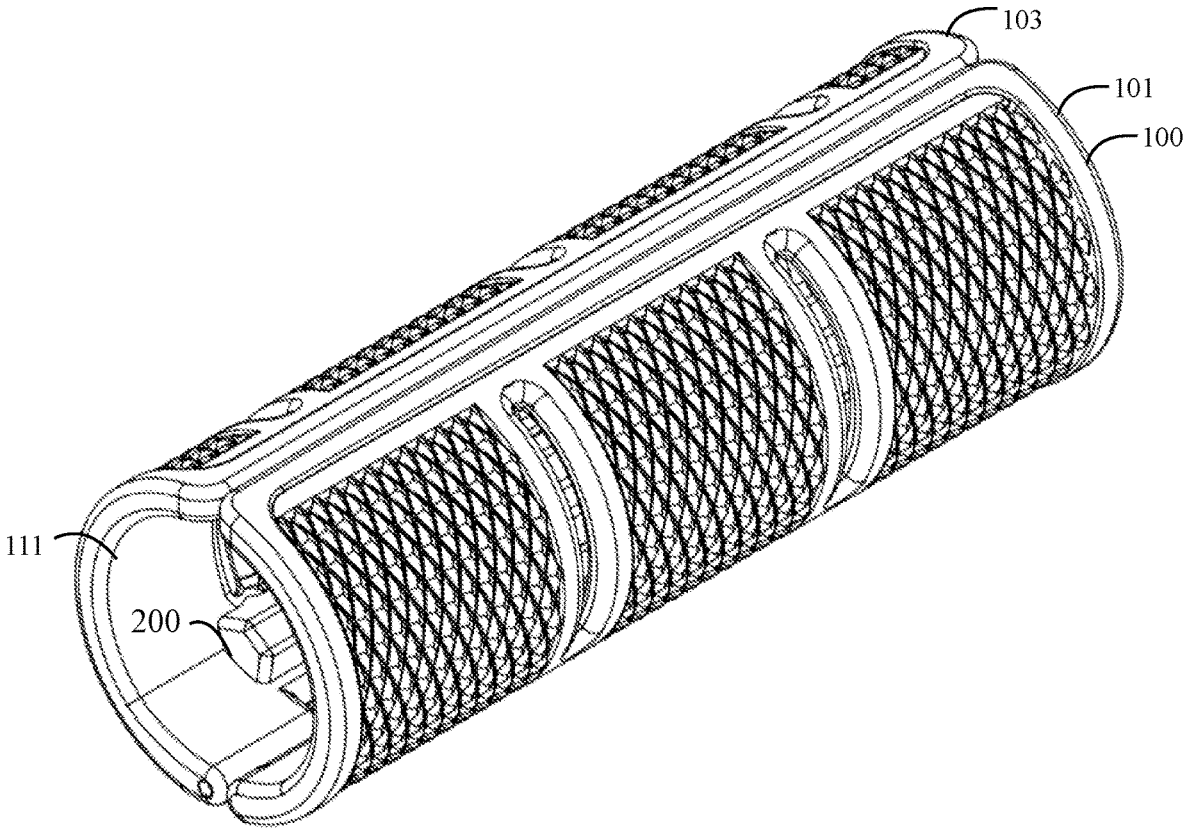
FIG. 2 illustrates a perspective view of the hockey stick grip assembly, according to some embodiments.

FIG. 1 and FIG. 2 illustrate the slidable and rotatable training and ergonomic handle 100 for an ice hockey stick (not pictured) including a first handle assembly body 101 and a second handle assembly body 103 configurable to hingeably form an elongated hollow body 105 enveloping a portion of an elongated shaft of the ice hockey stick. The elongated hollow body 105 includes a general outer surface 108 configured to allow the user to hold the ice hockey stick hand assembly with their hand, and a general inner surface 107 surrounding a portion of the elongated shaft of the ice hockey stick. The first handle assembly body 101 and second handle assembly body 103 each define an essentially semi-cylindrical shell 109 configurable to hingeably form an essentially elongated tubular body 111.

In some embodiments, a connecting hinge pin 113 joins the first and second handle assembly bodies 101, 103 via at least one hinge knuckle 115 integral with each separate handle assembly body.

In some embodiments, the assembly is further configurable to be slidable along a section of the elongated shaft of an ice hockey stick, such that the shaft slide through the interior through hole of the assembly.

In some embodiments, the assembly is further configurable to be rotatable around the elongated shaft of an ice hockey stick.

In one aspect, the assembly includes at least one hinge knuckle 115 on the first handle assembly body 101 defining a detent 117 engageable with a notch 119 defined on the second handle assembly body 103.

In some embodiments, the first and second handle assembly bodies 101, 103 each define at least two spaced slots 121,123 the first and second handle assembly bodies 101, 103 configured to respectively receive and retain a first and a second strap on the inner surface 107 of the generally tubular body 101 wherein each of the first and second straps is integral with loopable material configured generally on the outside of the generally tubular body 101.

In some embodiments, the first and second handle assembly bodies 101, 103 each further define recesses between at least two defined slots. The recesses may not be traversing the entire thickness of the elongated hollow body and being further configured to receive and recess a strap.

In some embodiments, the assembly includes a first raised spacer 200 orientated longitudinally along the inner surface of the first handle assembly body adjacent to at least one defined recess of the first handle assembly configurable to space the elongated shaft of the hockey stick and a first strap.

Further the assembly includes a second raised spacer (not shown) orientated longitudinally along the inner surface of the second handle assembly body adjacent to at least one defined recess of the second handle assembly configurable to space the elongated shaft of the hockey stick and a second strap.

Figure 3:
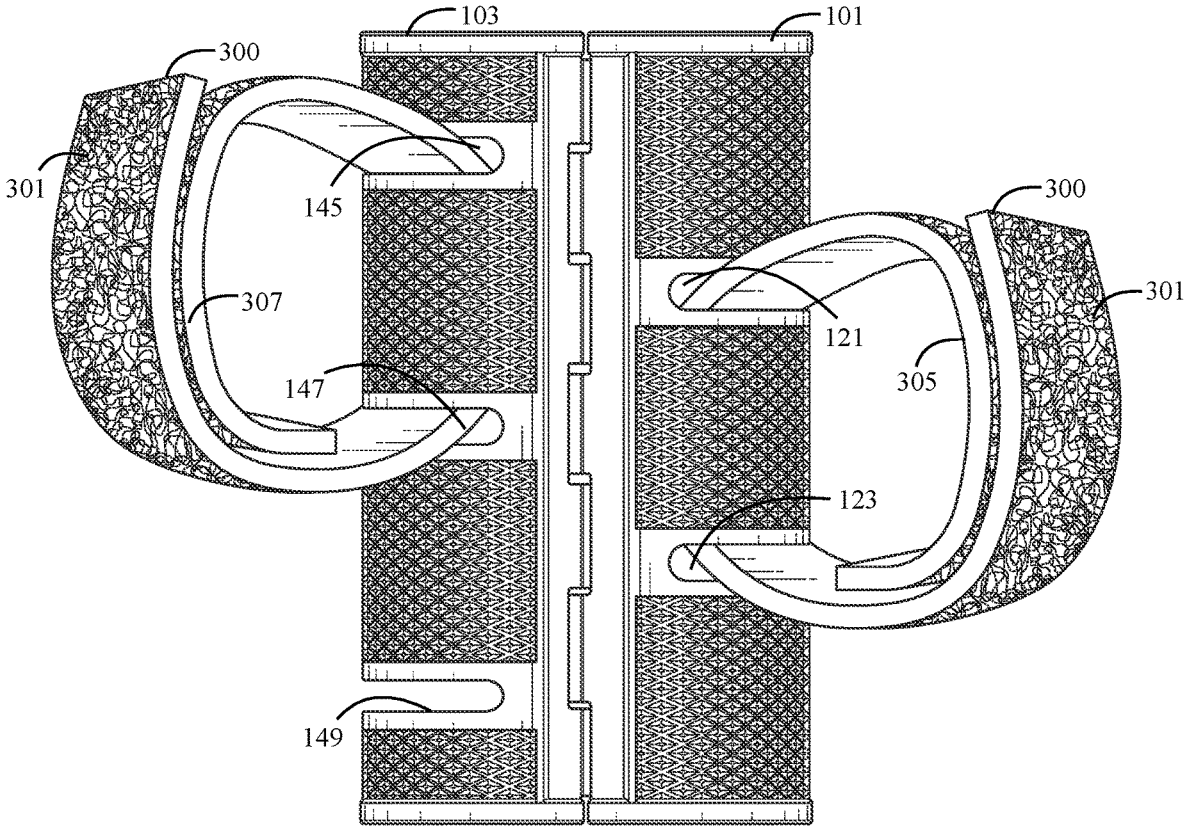
FIG. 3 illustrates a perspective view of the hockey stick grip assembly including the loopable material according to some embodiments.

FIG. 3 illustrates a loopable material 300 comprises a hook and loop material 301 configurable to attach to itself while wrap around some portion of a user's hand. The first handle assembly body 101 defines two spaced slots 121, 123 in staggered formation with three spaced slots 145,147,149 defined by the second handle assembly body 103. The two spaced slots 121, 123 defined by the first handle assembly 101 anchor a first loop 305 configured to retain some portion of an upper limb of a user while two spaced slots 145, 147 defined by the second handle assembly 103 anchor a second loop 307 configured to retain a thumb of a user.

In some embodiments, the assembly is configured to limit a user's ability to firmly grip the elongated shaft of the ice hockey stick thereby encouraging the user to rely more on manipulating another hand closer to a butt end of the ice hockey stick.

In some embodiments, the assembly may be comprised of a rigid material such as plastic.

In some embodiments, the general outer surface is defined by the first and second handle assembly body and includes a slip resistant texture and/or a slip resistant material.

In some embodiments, the two straps consist of neoprene and hook and loop fastener material. The neoprene allows for friction to keep the assembly attached to the user's hand. The hook and loop fastener material allows for the strap to be connected at each end around the user's fingers and thumb, or back of the hand or gloved hand. The elasticity and friction of the strap keeps the device in place in the palm of the user's hand or gloved hand.

The device is designed to be worn by left or right handed players. On the half having three slots, the user should use the middle slot and then either outside slot depending on if they are attaching to the left or right hand.

In some embodiments, the assembly is assembled by attaching a strap to a first slot. The strap is then attached to the middle and ring finger of the user's hand or gloved hand. The second strap is connected to the slots on the second assembly body. The second strap is typically wrapped around the user's thumb. However, it can also be secured by wrapping it around the back of the hand or gloved hand.

In some embodiments, the assembly may be constructed of any suitable material including HDPE plastic (or similar materials) and may be produce using injection molding. One skilled in the arts will readily understand that various materials and production processes may be utilized.

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety to the extent allowed by applicable law and regulations. The systems and methods described herein may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

The foregoing is provided for purposes of illustrating, explaining, and describing embodiments of this disclosure. Modifications and adaptations to these embodiments will be apparent to those skilled in the art and may be made without departing from the scope or spirit of this disclosure.

As used herein and in the appended claims, the singular forms "a", "an", and "the" include plural referents unless the context clearly dictates otherwise.

It should be noted that all features, elements, components, functions, and steps described with respect to any embodiment provided herein are intended to be freely combinable and substitutable with those from any other embodiment. If a certain feature, element, component, function, or step is described with respect to only one embodiment, then it should be understood that that feature, element, component, function, or step can be used with every other embodiment described herein unless explicitly stated otherwise. This paragraph therefore serves as antecedent basis and written support for the introduction of claims, at any time, that combine features, elements, components, functions, and steps from different embodiments, or that substitute features, elements, components, functions, and steps from one embodiment with those of another, even if the description does not explicitly state, in a particular instance, that such combinations or substitutions are possible. It is explicitly acknowledged that express recitation of every possible combination and substitution is overly burdensome, especially given that the permissibility of each and every such combination and substitution will be readily recognized by those of ordinary skill in the art.

In many instances entities are described herein as being coupled to other entities. It should be understood that the terms "coupled" and "connected" (or any of their forms) are used interchangeably herein and, in both cases, are generic to the direct coupling of two entities (without any non-negligible (e.g., parasitic intervening entities) and the indirect coupling of two entities (with one or more non-negligible intervening entities). Where entities are shown as being directly coupled together or described as coupled together without description of any intervening entity, it should be understood that those entities can be indirectly coupled together as well unless the context clearly dictates otherwise.

While the embodiments are susceptible to various modifications and alternative forms, specific examples thereof have been shown in the drawings and are herein described in detail. It should be understood, however, that these embodiments are not to be limited to the particular form disclosed, but to the contrary, these embodiments are to cover all modifications, equivalents, and alternatives falling within the spirit of the disclosure. Furthermore, any features, functions, steps, or elements of the embodiments may be recited in or added to the claims, as well as negative limitations that define the inventive scope of the claims by features, functions, steps, or elements that are not within that scope.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described herein. A variety of modifications and variations are possible in light of the above teachings without departing from the following claims.

What is claimed is:

1. An ice hockey stick handle assembly, comprising:

a first handle assembly body and a second handle assembly body each defining an essentially semi-cylindrical shell configurable to hingeably form an elongated hollow body enveloping a portion of an elongated shaft of an ice hockey stick, wherein the elongated hollow body is configurable to be slidable along a section of the elongated shaft of the ice hockey stick and rotatable around the elongated shaft of the ice hockey stick, and wherein the elongated hollow body comprises:

a general outer surface configured to allow the user to hold the ice hockey stick handle assembly with their hand;

a general inner surface generally surrounding a portion of the elongated shaft of the ice hockey stick;

wherein the first and second handle assembly bodies each define at least two spaced slots, the first and second handle assembly bodies configured to respectively receive and retain a first and a second strap on an inside surface of the elongated hollow body, wherein each of the first and second straps is integral with loopable material configured generally on an outside of the elongated hollow body.

2. The assembly of claim 1, further comprising: a connecting hinge pin joining the first and second handle assembly bodies via at least one hinge knuckle integral with each separate handle assembly body.

3. The assembly of claim 1, further comprising at least one hinge knuckle on the first handle assembly body defining a detent engageable with a notch defined on the second handle assembly body.

4. The assembly of claim 1, wherein the loopable material comprises a hook and loop material configurable to attach to itself while wrapping around some portion of a user's hand.

5. The assembly of claim 1, wherein the first and second handle assembly bodies each further define recesses between at least two defined slots, said recesses not traversing the entire thickness of the elongated hollow body and being further configured to receive and recess a strap.

6. The assembly of claim 5, further comprising:

a first raised spacer orientated longitudinally along the inner surface of the first handle assembly body adjacent to at least one defined recess of the first handle assembly configurable to space the elongated shaft of the hockey stick and a first strap; and a second raised spacer orientated longitudinally along the inner surface of the second handle assembly body adjacent to at least one defined recess of the second handle assembly configurable to space the elongated shaft of the hockey stick and a second strap.

7. The assembly of claim 1, wherein the first handle assembly body defines two spaced slots in staggered formation with three spaced slots defined by the second handle assembly body.

8. The assembly of claim 6, wherein two spaced slots defined by the first handle assembly anchor a first loop configured to retain some portion of an upper limb of a user while two spaced slots defined by the second handle assembly anchor a second loop configured to retain a thumb of a user.

9. The assembly of claim 7, further configured to limit a user's ability to firmly grip the elongated shaft of the ice hockey stick thereby encouraging the user to rely more on manipulating another hand closer to a butt end of the ice hockey stick.

10. The assembly of claim 1, further being comprised of a rigid material.

11. The assembly of claim 10, wherein the rigid material comprises plastic.

12. The assembly of claim 1, wherein the general outer surface is defined by the first and second handle assembly body and includes a slip resistant texture.

13. The assembly of claim 1, wherein the general outer surface comprises a slip resistant material.

14. An ice hockey stick handle assembly, comprising:

a first handle assembly body and a second handle assembly body configured to hingeably form an elongated hollow body enveloping a portion of an elongated shaft of an ice hockey stick, wherein the elongated hollow body includes a slip-resistant texture, is comprised of slip-resistant material, and further comprises:

a general outer surface configured to allow the user to hold with a hand;

a general inner surface enveloping a section of the elongated shaft of the ice hockey stick;

wherein the elongated hollow body is further configurable to be slidable along a section of the elongated shaft of an ice hockey stick, and further configurable to be rotatable around the elongated shaft of an ice hockey stick;

a connecting hinge pin joining the first and second handle assembly bodies via at least one hinge knuckle integral with each separate handle assembly body;

wherein the first and second handle assembly bodies each define at least two spaced slots, the first and second handle assembly bodies configured to respectively receive and retain a first and a second strap on an inside surface of the elongated hollow body, wherein each of the first and second straps is integral with loopable material configured generally on an outside of the elongated hollow body.

15. An ice hockey stick handle assembly, comprising:

a first handle assembly body and a second handle assembly body each defining an essentially semi-cylindrical shell configurable to hingeably form an elongated tubular body enveloping a portion of an elongated shaft of an ice hockey stick, wherein the elongated tubular body is configured to be slidable along a section of the elongated shaft of an ice hockey stick as well as rotatable around the elongated shaft of the hockey stick, and comprises:

a general outer surface including slip-resistant material, having a slip-resistant texture, and being configured to allow the user to hold the ice hockey stick handle assembly with their hand;

a general inner surface generally surrounding a portion of the elongated shaft of the ice hockey stick;

wherein the first and second handle assembly bodies each define at least two spaced slots, the first and second handle assembly bodies configured to respectively receive and retain a first and a second strap on the inside surface of the generally tubular body wherein each of the first and second straps is integral with loopable material configured generally on the outside of the generally tubular body;

wherein the first and second handle assembly bodies each further define recesses between at least two defined slots, said recesses not traversing the entire thickness of the elongated hollow body and being further configured to receive and recess a strap;

a connecting hinge pin joining the first and second handle assembly bodies via at least one hinge knuckle integral with each separate handle assembly body;

a first raised spacer orientated longitudinally along the inner surface of the first handle assembly body adjacent to at least one defined recess of the first handle assembly configurable to space the elongated shaft of the hockey stick and a first strap; and;

a second raised spacer orientated longitudinally along the inner surface of the second handle assembly body adjacent to at least one defined recess of the second handle assembly configurable to space the elongated shaft of the hockey stick and a second strap.

* * * * *